US010916390B2

(12) United States Patent
Yuan

(10) Patent No.: US 10,916,390 B2
(45) Date of Patent: Feb. 9, 2021

(54) SIDE KEY STRUCTURE AND ELECTRONIC DEVICE HAVING SAME

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventor: Bo-Duo Yuan, Shenzhen (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/433,587

(22) Filed: Jun. 6, 2019

(65) Prior Publication Data

US 2020/0294741 A1 Sep. 17, 2020

(30) Foreign Application Priority Data

Mar. 14, 2019 (CN) ..... 2019 1 0194622

(51) Int. Cl.

| | |
|---|---|
| ***H01H 21/06*** | (2006.01) |
| ***H01H 13/705*** | (2006.01) |
| ***H01H 21/22*** | (2006.01) |
| *H01H 1/58* | (2006.01) |

(52) U.S. Cl.

CPC ..... *H01H 21/06* (2013.01); *H01H 13/705* (2013.01); *H01H 21/22* (2013.01); *H01H 2001/5816* (2013.01); *H01H 2221/008* (2013.01); *H01H 2221/044* (2013.01)

(58) Field of Classification Search

CPC .. H01H 13/14; H01H 13/705; H01H 13/7057; H01H 2001/5816; H01H 2221/05; H05K 5/0204; H05K 5/0247

See application file for complete search history.

(56) References Cited

U.S. PATENT DOCUMENTS

| | | | | |
|---|---|---|---|---|
| 8,331,107 | B2 * | 12/2012 | Ouyang | H04M 1/236 361/807 |
| 8,373,975 | B2 * | 2/2013 | Liang | H01H 13/705 361/679.02 |
| 9,629,268 | B2 * | 4/2017 | Lee | H05K 7/1427 |
| 10,056,204 | B2 * | 8/2018 | Lee | H04M 1/236 |
| 10,437,289 | B2 * | 10/2019 | Chang | G06F 3/0202 |
| 2010/0258421 | A1 * | 10/2010 | Chen | H04M 1/236 200/341 |

* cited by examiner

*Primary Examiner* — Vanessa Giradi
(74) *Attorney, Agent, or Firm* — ScienBiziP, P.C.

(57) ABSTRACT

A side key structure of an electronic device includes a housing, a flexible circuit board, and a side key. The housing defines a receiving groove. The flexible circuit board includes a key switch. The side key includes a main key body, a fastener, and a pressing portion. The flexible circuit board is mounted on a sidewall of the receiving groove. The pressing portion and the fastener are arranged on a same side of the main key body. The main key body is partially received in the receiving groove. The fastener and the pressing portion pass through a second sidewall of the receiving groove. The fastener is mounted within the receiving groove. The main key body is configured to be pressed to cause the pressing portion to press the key switch to activate the key switch.

18 Claims, 5 Drawing Sheets

SIDE KEY STRUCTURE AND ELECTRONIC DEVICE HAVING SAME

FIELD

The subject matter herein generally relates to electronic devices, and more particularly to a side key structure of an electronic device.

BACKGROUND

Generally, when installing a side key of an electronic device, an end of a side key bracket is inserted through a sidewall of a housing of the electronic device into a receiving slot containing a flexible circuit board. Support foam and a silicone ring are attached to the end of the side key bracket to prevent the side key from falling off the housing. However, due to limited space of the receiving slot of the housing, the structure of the side key bracket, the support foam, and the silicone ring are small, and manual installation is inconvenient, time-consuming, and labor-intensive.

BRIEF DESCRIPTION OF THE DRAWINGS

Implementations of the present disclosure will now be described, by way of embodiments, with reference to the attached figures.

DETAILED DESCRIPTION

Figure 1:
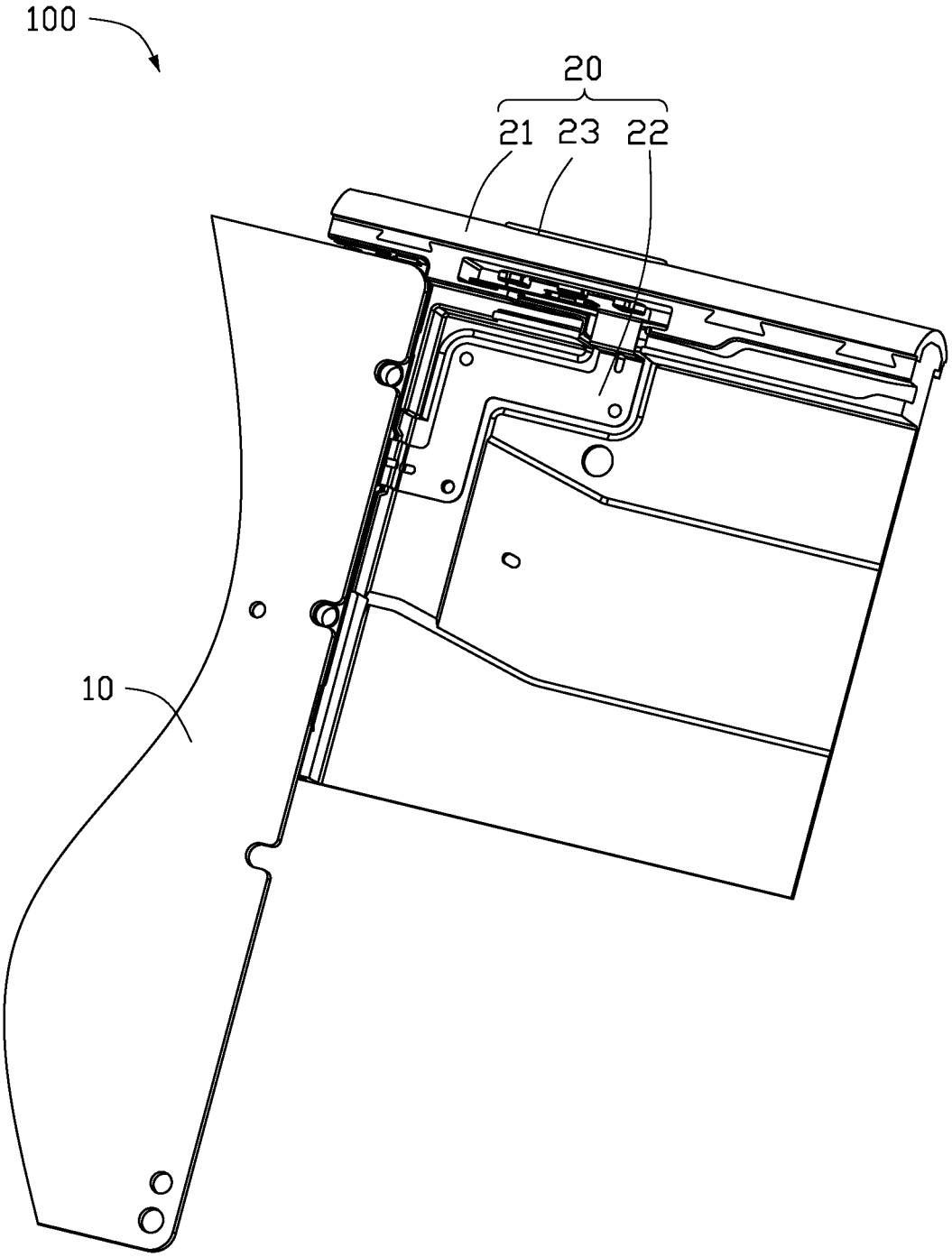
FIG. 1 is a partial isometric view of an embodiment of an electronic device including a side key structure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of an electronic device 100 including a motherboard 10 and a side key structure 20.

Figure 2:
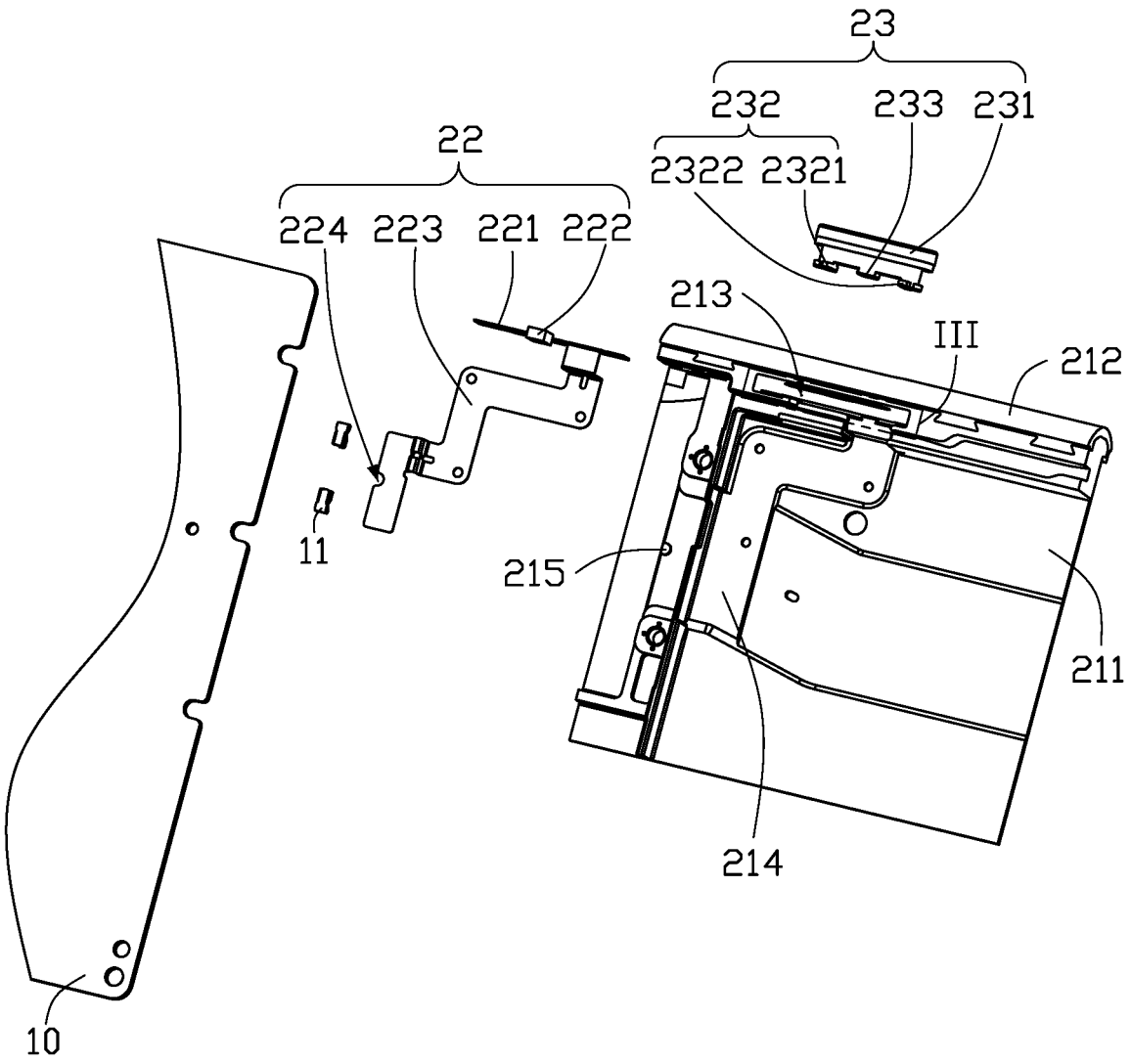
FIG. 2 is an exploded, isometric view of FIG. 1.

Referring to FIGS. 1 and 2, the motherboard 10 includes a conductive elastic member 11. One end of the conductive elastic member 11 is coupled to an internal circuit on the motherboard 10, and a second end of the conductive elastic member 11 is electrically coupled to the side key structure 20. As shown in FIG. 2, a quantity of the conductive elastic member 11 is two, and the two elastic members 11 are spaced apart on the motherboard 10.

The side key structure 20 includes a housing 21, a flexible circuit board 22, and a side key 23. The flexible circuit board 22 and the side key 23 are mounted on the housing 21. In one embodiment, the electronic device 100 may be, but is not limited to, a mobile phone, a camera, or a tablet computer.

Figure 3:
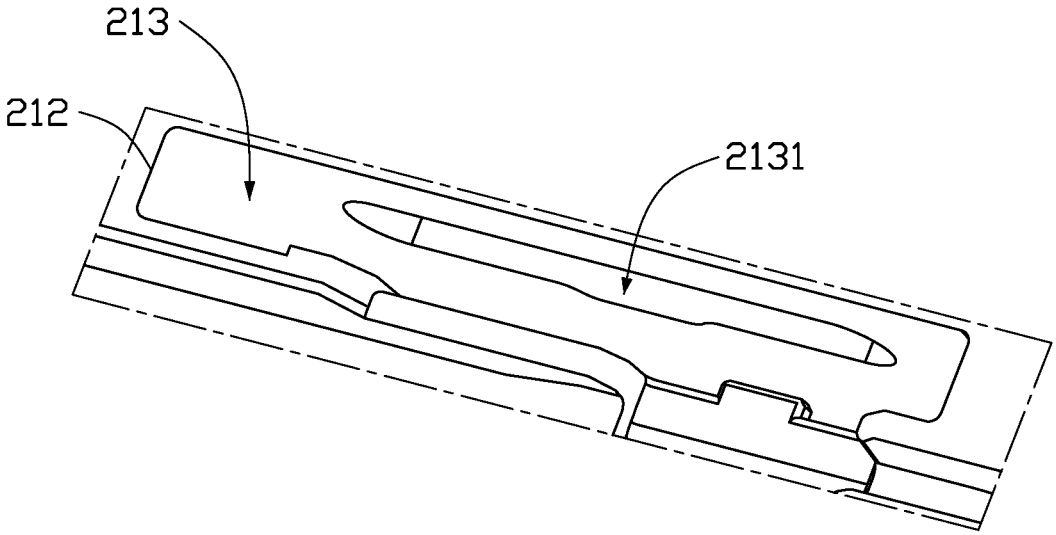
FIG. 3 is a close-up view of a portion III in FIG. 2.
Figure 4:
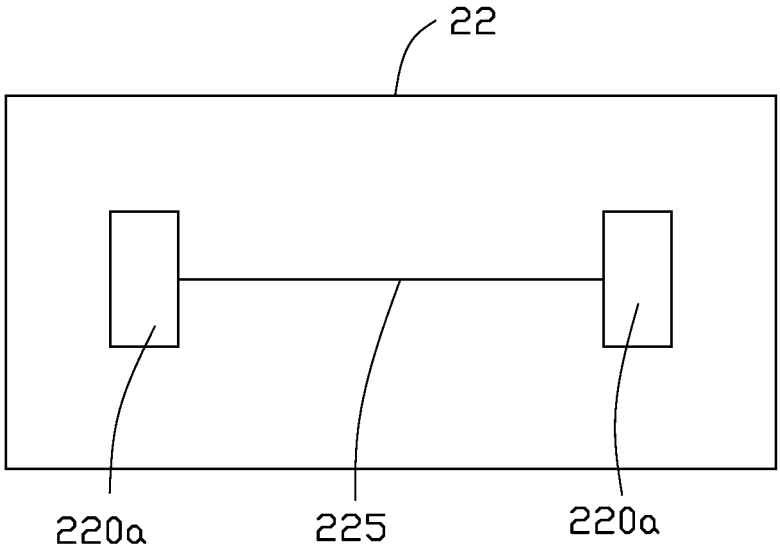
FIG. 4 is a schematic diagram of an embodiment of a flexible circuit board.
Figure 5:
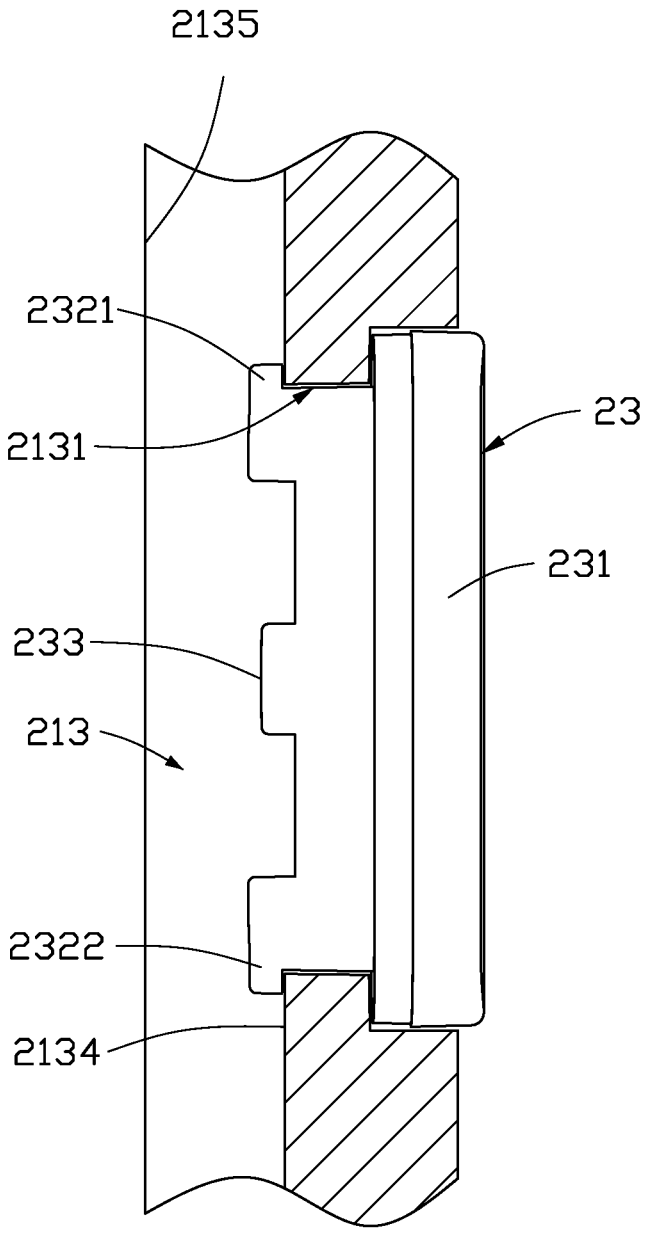
FIG. 5 is a partial cross-sectional view of the electronic device of the FIG. 1.

The housing 21 includes a base plate 211, a border frame 212, a receiving groove 213, a contoured groove 214, and a positioning post 215. The base plate 211 is substantially rectangular planar. The border frame 212 is mounted on a side edge of the base plate 211. The receiving groove 213 is a rectangular through groove defined through opposite sides of the border frame 212. A mounting hole 2131 (shown in FIG. 3) is recessed from a second sidewall 2134 of the receiving groove 213 and penetrate the second sidewall 2134 of the receiving groove 213. One end of the mounting hole 2131 is located on a sidewall of the receiving groove 213 away from the base plate 211. A second end of the mounting hole 2131 extends through a side surface of the border frame 212 away from the base plate 211. The contoured groove 214 is substantially stepped and is defined in the base plate 211. The contoured groove 214 conforms to an outer shape of the flexible circuit board 22. A surface of the contoured groove 214 includes a layer of adhesive (not shown) to make the flexible circuit board 22 adhere to the surface of the contoured groove 214. A plurality of the positioning posts 215 are spaced apart in the contoured groove 214. In one embodiment, the base plate 211 and the border frame 212 are integrally formed.

The flexible circuit board 22 includes a main circuit body 221, a key switch 222, at least one extending portion 223, a positioning hole 224, and a signal trace 225. The main circuit body 221 is substantially rectangular and configured to be attached to a first sidewall 2135 of the receiving groove 213 opposite to the mounting hole 2131. A layer of adhesive (not shown) is disposed between the main circuit body 221 and the first sidewall 2135 of the receiving groove 213. The key switch 222 is mounted on a side of the flexible circuit board 22 to be adjacent to the mounting hole 2131. The extending portion 223 is substantially stepped. One end of the extending portion 223 is coupled to the main circuit body 221, and a second end of the extending portion 223 is coupled to the base plate 211 and to the motherboard 10. An outer shape of the extending portion 223 corresponds to the shape of the contoured groove 214 and is adhered in the contoured groove 214. A plurality of the positioning holes 224 are defined in the extending portion 223 and respectively receive the positioning posts 215 to mount the extending portion 223. The flexible circuit board 22 further includes two exposed copper regions **220*a*. One of the exposed copper regions 220*a* is located on the main circuit body 221 and is configured to couple to the key switch 222, and another of the exposed copper regions 220*a* is located on the extending portion 223 and is configured to couple to the motherboard 10. Two ends of the signal trace 225 are respectively coupled to the two exposed copper regions 220***a*. In one embodiment, the key switch 222 may be a metal dome switch or a switch button.

The side key 23 includes a main key body 231, a fastener 232, and a pressing portion 233. The main key body 231 is substantially rectangular and is partially received in the receiving groove 213. The fastener 232 includes a first latching portion 2321 and a second latching portion 2322 arranged on a same side of the main key body 231. The first latching portion 2321 and the second latching portion 2322 are received through the mounting hole 2131. The pressing portion 233 is disposed on the main key body 231 and located between the first latching portion 2321 and the second latching portion 2322. The pressing portion 233 is configured to press the key switch 222 on the flexible circuit board 22 when the main key body 231 is pressed. In one embodiment, the first latching portion 2321, the second latching portion 2322, and the pressing portion 233 are made of flexible material, such as silicone.

In assembly, the motherboard 10 is first mounted on the base plate 211, and then the main circuit body 221 is attached to the first sidewall 2135 of the receiving groove 213 opposite to the mounting hole 2131, and the extending portion 223 is adhered in the contoured groove 214 and electrically coupled to the conductive elastic member 11 on the motherboard 10. Then, the fastener 232 of the side key 23 is received through the mounting hole 2131 to be mounted in the receiving groove 213. The side key 23 is configured to be pressed to cause the pressing portion 233 to activate the key switch 222.

It can be understood that in other embodiments, the fastener 232 may only include the first latching portion 2321 or the second latching portion 2322.

It can be understood that in other embodiments, the receiving groove 213 may be a blind groove.

It can be understood that in other embodiments, the extending portion 223 may be another shape, as long as one end of the extending portion 223 is coupled to the main circuit body 221, and the second end of the extending portion 223 is coupled to the base plate 211 and to the motherboard 10.

Compared with the related art, the fastener 232 is passed through the mounting hole 2131 to be mounted in the receiving groove 213, and the main key body 231 is pressed to cause the pressing portion 233 to activate the key switch 222. The structure is simple and easy to install, thereby saving time and effort.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A side key structure of an electronic device, the side key structure comprising:

a housing defining a receiving groove;

a flexible circuit board comprising a key switch; and a side key comprising a main key body, a fastener, and a pressing portion; wherein:

the flexible circuit board is mounted on a first sidewall of the receiving groove;

the pressing portion and the fastener are arranged on a same side of the main key body;

the main key body is partially received in the receiving groove;

the fastener and the pressing portion pass through a second sidewall of the receiving groove facing the first sidewall of the receiving groove;

the fastener is mounted within the receiving groove, the fastener and the main key body cooperate with to clamp the second sidewall of the receiving groove between the fastener and the main key body to fix the side key on the housing;

the main key body is configured to be pressed to cause the pressing portion to press the key switch to activate the key switch.

2. The side key structure of claim 1, wherein:

the key switch is a metal dome switch or a switch button.

3. The side key structure of claim 1, wherein:

the fastener is made of flexible material.

4. The side key structure of claim 1, wherein:

the second sidewall of the receiving groove defines a mounting hole;

the fastener is configured to be mounted in the receiving groove.

5. The side key structure of claim 1, wherein:

the fastener comprises a first latching portion and a second latching portion arranged on a same side of the main key body;

the pressing portion is arranged between the first latching portion and the second latching portion.

6. The side key structure of claim 1, wherein:

the key switch is coupled to an exposed copper region located at one end of a signal trace of the flexible circuit board; and the key switch is coupled to a motherboard of the electronic device by the signal trace.

7. The side key structure of claim 6, wherein:

the flexible circuit board comprises a main circuit body and an extending portion;

the main circuit body is adhered to the first sidewall of the receiving groove;

the extending portion extends from the main circuit body to the receiving groove;

the key switch is coupled to the exposed copper region located on the main key body;

the motherboard is coupled to the exposed copper region located on the extending portion.

8. The side key structure of claim 7, wherein:

the extending portion defines at least one positioning hole;

the housing comprises at least one positioning post;

a quantity of the positioning hole is the same as a quantity of the positioning post;

the at least one positioning post is configured to pass through the at least one positioning hole to position the extending portion.

9. The side key structure of claim 8, wherein:

the housing defines a contoured groove conforming in shape to an outer shape of the flexible circuit board;

the extending portion is adhered to a surface of the contoured groove.

10. An electronic device comprising:

a motherboard; and a side key structure electrically coupled to the motherboard, the side key structure comprising:

a housing defining a receiving groove;

a flexible circuit board comprising a key switch; and a side key comprising a main key body, a fastener, and a pressing portion;

wherein:

the motherboard is mounted on the housing;

the flexible circuit board is mounted on a first sidewall of the receiving groove;

the pressing portion and the fastener are arranged on a same side of the main key body;

the main key body is partially received in the receiving groove;

the fastener and the pressing portion pass through a second sidewall of the receiving groove facing the first sidewall of the receiving groove;

the fastener is mounted within the receiving groove, the fastener and the main key body cooperate with to clamp the second sidewall of the receiving groove between the fastener and the main key body to fix the side key on the housing;

the main key body is configured to be pressed to cause the pressing portion to press the key switch to activate the key switch.

11. The electronic device of claim 10, wherein:

the key switch is a metal dome switch or a switch button.

12. The electronic device of claim 10, wherein:

the fastener is made of flexible material.

13. The electronic device of claim 10, wherein:

the second sidewall of the receiving groove defines a mounting hole;

the fastener is configured to be pressed to pass through the mounting hole to be mounted in the receiving groove.

14. The electronic device of claim 10, wherein:

the fastener comprises a first latching portion and a second latching portion arranged on a same side of the main key body;

the pressing portion is arranged between the first latching portion and the second latching portion.

15. The electronic device of claim 10, wherein:

the key switch is coupled to an exposed copper region located at one end of a signal trace of the flexible circuit board; and the motherboard is coupled to an exposed copper region located at a second end of the signal trace.

16. The electronic device of claim 15, wherein:

the flexible circuit board comprises a main circuit body and an extending portion;

the main circuit body is adhered to the first sidewall of the receiving groove;

the extending portion extends from the main circuit body to the receiving groove;

the key switch is coupled to the exposed copper region located on the main key body;

the motherboard is coupled to the exposed copper region located on the extending portion.

17. The electronic device of claim 16, wherein:

the extending portion defines at least one positioning hole;

the housing comprises at least one positioning post;

a quantity of the positioning hole is the same as a quantity of the positioning post;

the at least one positioning post is configured to pass through the at least one positioning hole to position the extending portion.

18. The electronic device of claim 17, wherein:

the housing defines a contoured groove conforming in shape to an outer shape of the flexible circuit board;

the extending portion is adhered to a surface of the contoured groove.

* * * * *